US007752973B2

(12) United States Patent
Zahn et al.

(10) Patent No.: US 7,752,973 B2
(45) Date of Patent: Jul. 13, 2010

(54) PARACHUTE ROCKET, IN PARTICULAR A PARACHUTE SIGNALING ROCKET AND/OR A PARACHUTE FLARE ROCKET, AND METHOD FOR THEIR PRODUCTION

(75) Inventors: Arthur Zahn, Schiffdorf (DE); Claudia Köster, Schiffdorf (DE)

(73) Assignee: Chemring Defence Germany GmbH (DE)

( * ) Notice: Subject to any disclaimer, the term of this patent is extended or adjusted under 35 U.S.C. 154(b) by 95 days.

(21) Appl. No.: 12/050,330

(22) Filed: Mar. 18, 2008

(65) Prior Publication Data

US 2009/0007812 A1 Jan. 8, 2009

(30) Foreign Application Priority Data

Mar. 27, 2007 (DE) ..... 10 2007 015 248

(51) Int. Cl.
*F42B 4/08* (2006.01)

(52) U.S. Cl. ..... 102/348; 102/354

(58) Field of Classification Search ..... 102/348, 102/354

See application file for complete search history.

(56) References Cited

U.S. PATENT DOCUMENTS

| | | | | | |
|---|---|---|---|---|---|
| 1,686,117 | A | * | 10/1928 | Ball | 102/337 |
| 2,606,495 | A | * | 8/1952 | Clauser et al. | 102/334 |
| 2,785,632 | A | * | 3/1957 | Clauser et al. | 102/340 |
| 3,068,756 | A | * | 12/1962 | Schermuly | 89/1.51 |
| 3,296,967 | A | | 1/1967 | Bounds et al. | |
| 3,633,507 | A | | 1/1972 | Morley | |
| 3,730,099 | A | * | 5/1973 | Schopp | 102/339 |
| 3,735,706 | A | * | 5/1973 | Elstow et al. | 102/340 |
| 3,750,574 | A | * | 8/1973 | Lohkamp | 102/340 |
| 3,795,194 | A | * | 3/1974 | Kendrick | 102/348 |
| 3,946,672 | A | | 3/1976 | Adams et al. | |
| 4,226,185 | A | | 10/1980 | Tobler et al. | |
| 4,889,053 | A | * | 12/1989 | Grosswendt et al. | 102/348 |
| 5,054,397 | A | * | 10/1991 | Hans et al. | 102/348 |
| 5,120,011 | A | * | 6/1992 | Mintgen et al. | 248/162.1 |
| 5,386,781 | A | * | 2/1995 | Day | 102/340 |
| 6,079,202 | A | * | 6/2000 | Cesaroni et al. | 60/263 |
| 2008/0289530 | A1 | * | 11/2008 | Adorjan et al. | 102/348 |

FOREIGN PATENT DOCUMENTS

| | | |
|---|---|---|
| DE | 21 27 273 | 12/1971 |
| DE | 3724588 A1 | 6/1988 |
| DE | 3707062 A1 | 8/1988 |
| EP | 0 284 651 | 10/1988 |
| GB | 181037 | 6/1922 |
| GB | 448958 | 6/1936 |

OTHER PUBLICATIONS

German Search Report in corresponding application No. 102007015248.7 filed on Mar. 27, 2007.

* cited by examiner

*Primary Examiner*—Troy Chambers
*Assistant Examiner*—Samir Abdosh
(74) *Attorney, Agent, or Firm*—Smith, Gambrell & Russell

(57) ABSTRACT

Parachute signaling rockets in which the parachute (18) is connected to the effect charge (14) in the form a plug connection (16). This plug connection (16) can be made automatically, so that there is no longer any need for the previous manual connection of the parachute (18) to the pyrotechnic effect charge (14) for the parachute signaling rocket according to the invention.

15 Claims, 4 Drawing Sheets

PARACHUTE ROCKET, IN PARTICULAR A PARACHUTE SIGNALING ROCKET AND/OR A PARACHUTE FLARE ROCKET, AND METHOD FOR THEIR PRODUCTION

STATEMENT OF RELATED APPLICATIONS

This patent application is based on and claims convention priority under 35 USC Section 119 on German patent application no. 10 2007 015 248.7 having a filing date of 27 Mar. 2007, which is incorporated herein in its entirety.

BACKGROUND OF THE INVENTION

1. Technical Field

The invention relates to a parachute rocket, in particular to a parachute signaling rocket and/or parachute flare rocket, having at least one pyrotechnic effect charge and having a parachute which is connected to the effect charge. The invention also relates to a method for producing a parachute rocket such as this, in which at least one effect charge is connected to a parachute.

2. Prior Art

Parachute rockets are normally used in order to indicate acute emergency situations, in particular for maritime and aviation purposes. They are then referred to as pyrotechnique signaling means. Furthermore, parachute rockets may also be used, for example for illumination purposes.

Parachute rockets have at least one parachute which results in the pyrotechnic signal being produced by an effect charge suspended on the parachute falling to earth slowly (braked).

Until now, parachute rockets have been assembled only manually since a permanent connection between the parachute, which is composed of soft, flexible material, together with the associated lines and the effect charge is made, for example with the aid of hooks, eyes or grommets, and this process cannot be mechanized. Manual connection of the parachute to the pyrotechnique effect charge is not an entirely safe process for the person who is carrying out the assembly process.

BRIEF SUMMARY OF THE INVENTION

The object of the invention is therefore to provide a parachute rocket and a method for its production, which allow the assembly process to be very largely automated.

In order to solve this problem, a parachute rocket has a parachute which is connected to the effect charge, wherein a plug connection is provided for connection of the at least one parachute to the at least one effect charge. Accordingly, the connection between the parachute and the effect charge is in the form of a plug connection. The parts of this plug connection can therefore be connected to one another, simply by plugging them together, easily and at low cost, preferably by machine. This machine connection is possible without any danger to personnel.

At least one part of the plug connection is in each case preferably arranged on the parachute and on the effect charge. This allows connection just by handling of the parts of the plug connection. In contrast to the previous manual production, the parts of the plug connection can therefore be plugged together in an automated manner, since the parts of the plug connection are permanently connected to one another as soon as they have been plugged together, by automatically latching in and being clamped, and without any further external action.

One particularly advantageous refinement of that part of the plug connection which is associated with the parachute provides for this part to be in the form of a flat element which has at least one opening. This opening can be designed such that it is used to hold a fitting mating piece, which is formed by that part of the plug connection that is associated with the effect charge.

In the plug connection according to the invention, the opening has at least one associated spring element, which, in particular, is in the form of a spring tongue, hook, barb, clamping ring or the like. Spring elements such as these can be formed easily and are used as clamping components or as barb components for the plug connection, therefore ensuring that the parts of the plug connection are permanently and reliably held together. A plurality of such spring elements are in one advantageous embodiment associated with an opening in a flat element, with these spring elements preferably being located at the edge of the opening and in particular projecting into the opening, so that the corresponding part of the plug connection which is arranged on the effect charge is held firmly in the opening by the spring elements. In this case, it is particularly advantageous for the free ends of the spring tongues to be aligned in the direction of the center of the opening, which in particular is round, thus allowing virtually any desired relative arrangement of the parts of the plug connection with respect to one another. In order to allow a uniform force distribution of the spring tongues on the mating piece of the plug connection, they are also advantageously arranged at the same distance from one another. The plurality of spring elements, in particular spring tongues, allows an adequately reliable connection to be made between the parachute and the effect charge even if one spring element fails.

An integral form of the flat element, including the spring tongues associated with it, has been found to be particularly advantageous since they can therefore be produced easily. A round, and in particular flat and level disk is preferably used as the flat element since it normally corresponds to the round shape of the parachute rocket.

That part of the plug connection which is arranged on the effect charge is advantageously in the form of a mating piece, in particular a splint or bolt, which is matched to that part of the plug connection which is arranged on the parachute. A splint or bolt such as this has a head which can be inserted just by elastic deformation of the spring tongues, into the corresponding opening in the fall element according to the invention. This therefore results in a restraining force being exerted on the splint or bolt by flexing of the spring tongues in the elastic range while the plug connection elements are being joined together and by the spring tongues autonomously springing back now that they are stressed as a result of the hooking process, so that the splint or bolt is fixed in the opening by the spring tongues firmly gripping the head of the splint or bolt, in the form of a barb, on the effect charge, preventing it from becoming loose from the disk to which the spring tongues are fitted.

In one advantageous embodiment of the parachute rocket, the disk which is associated with the plug connection has at least one further opening to which the parachute can be attached. The holding and/or connecting lines of the parachute are preferably used for this purpose, with these lines in particular being passed through at least one opening for this purpose and, for example, being knotted or else adhesively bonded. In preparation for the rest of the automatic assembly process, the parachute can therefore be directly connected in one process to the disk which forms a part of the plug connection. This can be done safely manually, because the pyrotechnic effect charge has not yet been connected to the parachute at this time.

The holding and connecting lines and/or the parachute material are/is preferably produced using heat-resistant or fire-resistant materials, since the parachute and its holding and connecting lines are subject to severe heating as a result of the burning effect charge located underneath them. In particular, silicate fibers, or else other heat-resistant synthetic fibers may be used for production.

The method according to the invention for solving the problem as stated above is a method for production of a parachute rocket, in which at least one effect charge is connected to a parachute, wherein one part of a plug connection is in each case associated with the effect charge and with the parachute, the parachute is arranged with that part of the plug connection which is associated with it in an assembly aid, and the effect charge is connected with the assistance of the assembly aid to that part of the plug connection which is arranged on the parachute, by means of that part of the plug connection which is associated with the effect charge and corresponds to that part of the plug connection which is associated with the parachute. Accordingly, one part of the plug connection is in each case associated with the parachute and the effect charge. The parachute and the first part of the plug connection which is associated with it are associated with an assembly aid in particular being arranged in it, such that the second part of the plug connection, which is arranged on the effect charge, can be connected easily, to be in precise in particular by machine, to that part of the plug connection which is arranged on the parachute, by means of the assembly aid.

The folded-up parachute together with the holding and/or connecting lines and that part of the plug connection which is associated with them or it are advantageously and preferably arranged in the assembly aid such that the first part of the plug connection is freely accessible for connection to the second part of the plug connection, preferably being located at the top, on the parachute, in the assembly aid. The connection between the parachute and the effect charge can therefore be made in a very simple and cost-effective manner just in one process, which can even be carried out by machine.

One preferred development of the method provides for the assembly aid to be in the form of an adapter sleeve which is reusable.

That part of the plug connection which is arranged on the effect charge, in particular a splint and/or bolt, is preferably connected to that part of the plug connection which is arranged on the parachute, in particular to the disk which is provided with spring tongues, by inserting it together with the effect charge into the adapter sleeve and pushing them together. The spring tongues, which are sprung in the elastic range, therefore ensure permanent connection of the parts of the plug connection by clamping and hooking, and therefore that the connection between the parachute and the effect charge is made. The parachute rocket can be produced automatically just by pushing the parts of the plug connection together, without any further process steps.

The adapter sleeve can introduced into a magazine before the plug connection is mated. The effect charge is also advantageously introduced into a magazine, so that in one preferred embodiment of the method, an adapter sleeve which is fitted with the folded parachute, the associated lines and the first part of the plug connection and an effect charge with the associated second part of the plug connection are removed from the respective magazines in each case. The folded parachute together with the first part of the plug connection in the adapter sleeve and the effect charge together with the second part of the plug connection are joined together only when the plug connection is mated.

BRIEF DESCRIPTION OF THE DRAWINGS

On preferred exemplary embodiment of the invention will be explained in the following text with reference to the drawing, in which.

DETAILED DESCRIPTION OF PREFERRED EMBODIMENTS

Figure 1:
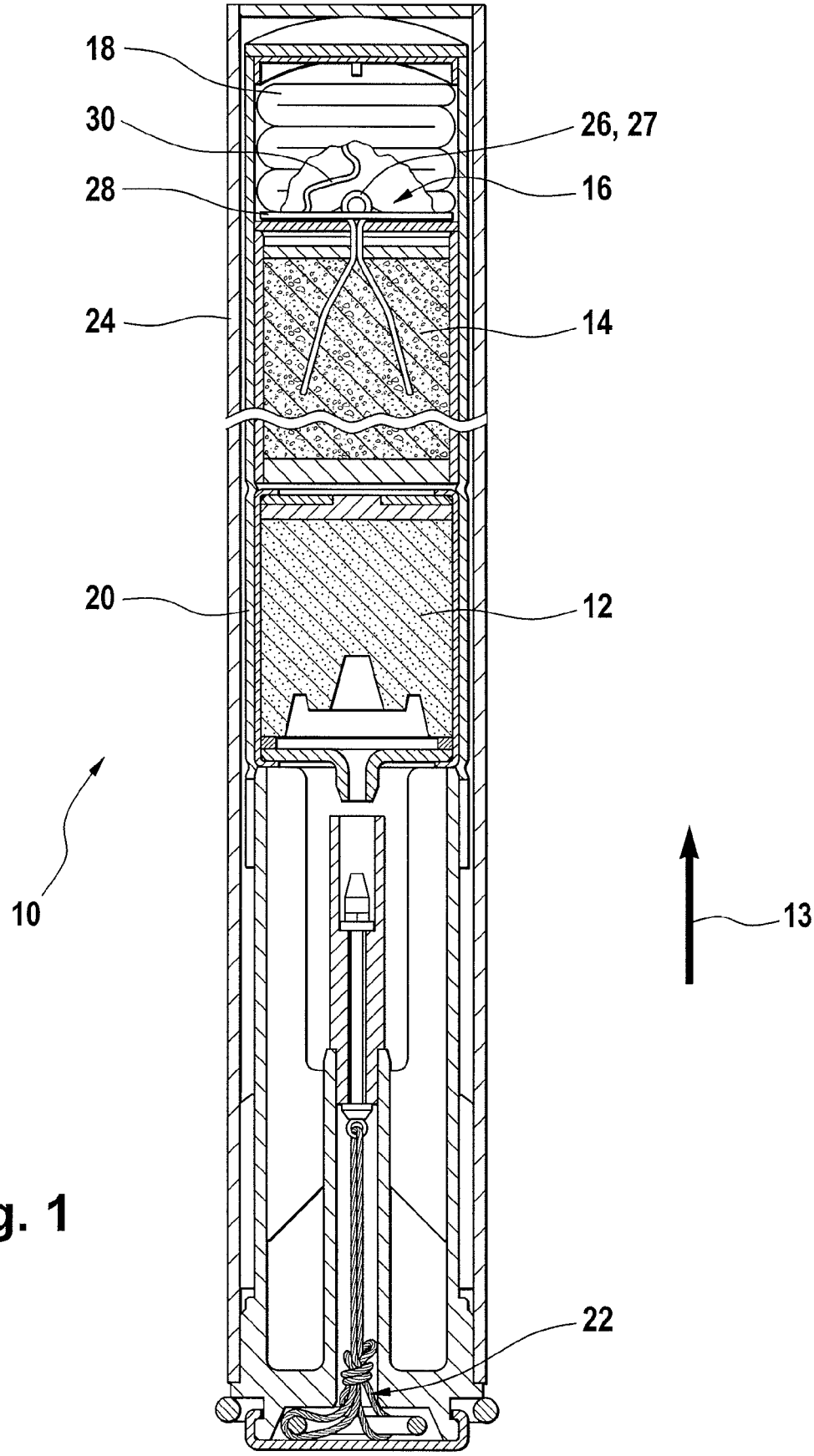
FIG. 1 shows a section through a parachute signaling rocket according to the invention.
Figure 2:
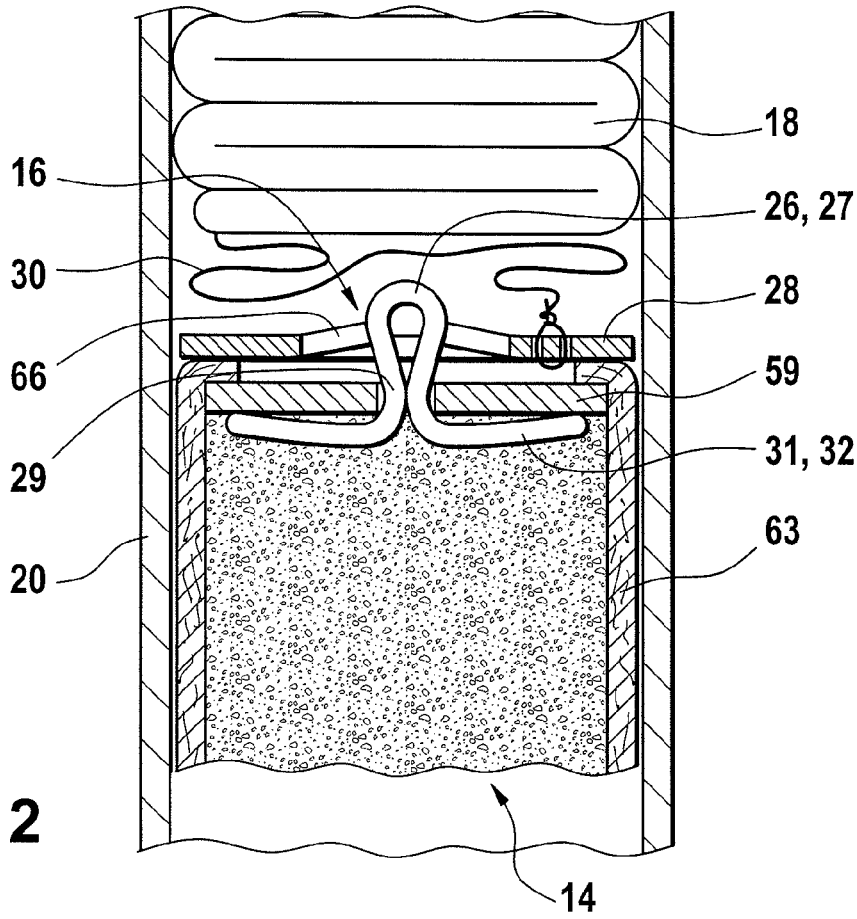
FIG. 2 shows an enlarged detail from FIG. 1, in the area of the parachute connected to the effect charge by the plug connection.

FIG. 1 shows a section through an entire parachute signaling rocket 10. The parachute signaling rocket 10 has a lower propellant charge 12, a pyrotechnic effect charge 14 arranged above it in the firing direction 13, and a parachute 18 above the effect charge 14. The effect charge 14 is provided with a pyrotechnique charge in order to produce the pyrotechnique signal, for example flare stars. The propellant charge 12, the effect charge 14 and the parachute 18 are arranged together in a rocket casing 20. The rocket casing 20 is surrounded by a longer outer casing 24, which, in particular, projects downwards with respect to the rocket casing 20 in order to hold an initiator 22. In the illustrated exemplary embodiment, this is a manual initiator.

The effect charge 14 and the parachute 18 are connected by a plug connection 16 in a particular manner according to the invention. The plug connection 16 comprises two parts, to be precise a first part which is connected to the parachute 18. This first part of the plug connection 16 is in the form of a circular disk 28 in the illustrated exemplary embodiment. The external diameter of the circular disk 28 is somewhat smaller than the internal diameter of the rocket casing 20 for holding the parachute 18, effect charge 14 as well as the plug connection 16. A second part of the plug connection 16 is associated with the effect charge 14. This part of the plug connection 16 in the illustrated exemplary embodiment is formed from a splint 26 whose head 27 projects upwards out of the effect charge 14.

In an edge area, the disk 28 has two attachment openings 60 and 62 which are used for attachment of the parachute 18 to the disk 28. In the illustrated exemplary embodiment, a holding line 30, which is passed through the attachment openings 60 and 62, of the parachute 18 is knotted to the disk 28. The holding line 30 is in turn connected to the lines of the parachute 18, which are not illustrated in any more detail. At least the holding line 30, but preferably also the other lines of the parachute 18, are formed from a heat-resistant material, for example a silicate yarn. The silicate yarn is a filament yarn composed of silicon fibers. A holding line 30 such as this is resistant to the heat produced by the burning effect charge 14 as it floats to the ground, hanging underneath the parachute 18.

An opening 64, which is cylindrical in the illustrated exemplary, is located in the center of the disk 28. A plurality of spring elements are arranged in a particular manner at the cylindrical edge with the opening 64 and, in the illustrated exemplary embodiment, are in the form of spring tongues 66. In the present case, the opening 64 has six identical associated spring tongues 66. The elongated spring tongues 66 extend radially to the center of the disk 28 or opening 64. The opening 64 is constricted by the free ends 65 of the spring tongues 66 which point towards the center, in the area of these free ends 65. The spring tongues 66 are integrally connected to the disk 28. The disk 28 is preferably formed from an elastically deformable material, in particular from spring steel. This allows the spring tongues 66 to be moved out of the plane of the disk 28, by elastic deformation, after which they spring back elastically, entirely or at least partially to return back into the plane of the disk 28. The free ends 65 of all the spring tongues 66 preferably lie on an imaginary circle or circle element whose center point is coincident with the center point of the opening 64, with the circle element having a diameter which is smaller by the length of two opposite spring tongues 66 than that of the opening 64. In the illustrated exemplary embodiment, the spring tongues 66 have an approximately rectangular footprint. It is also feasible for the spring tongues 66 to be entirely or partially rounded in the area of the free ends 65. Alternatively or additionally, it is also possible for the spring tongues 66 to taper towards the free ends 65.

Figure 6:
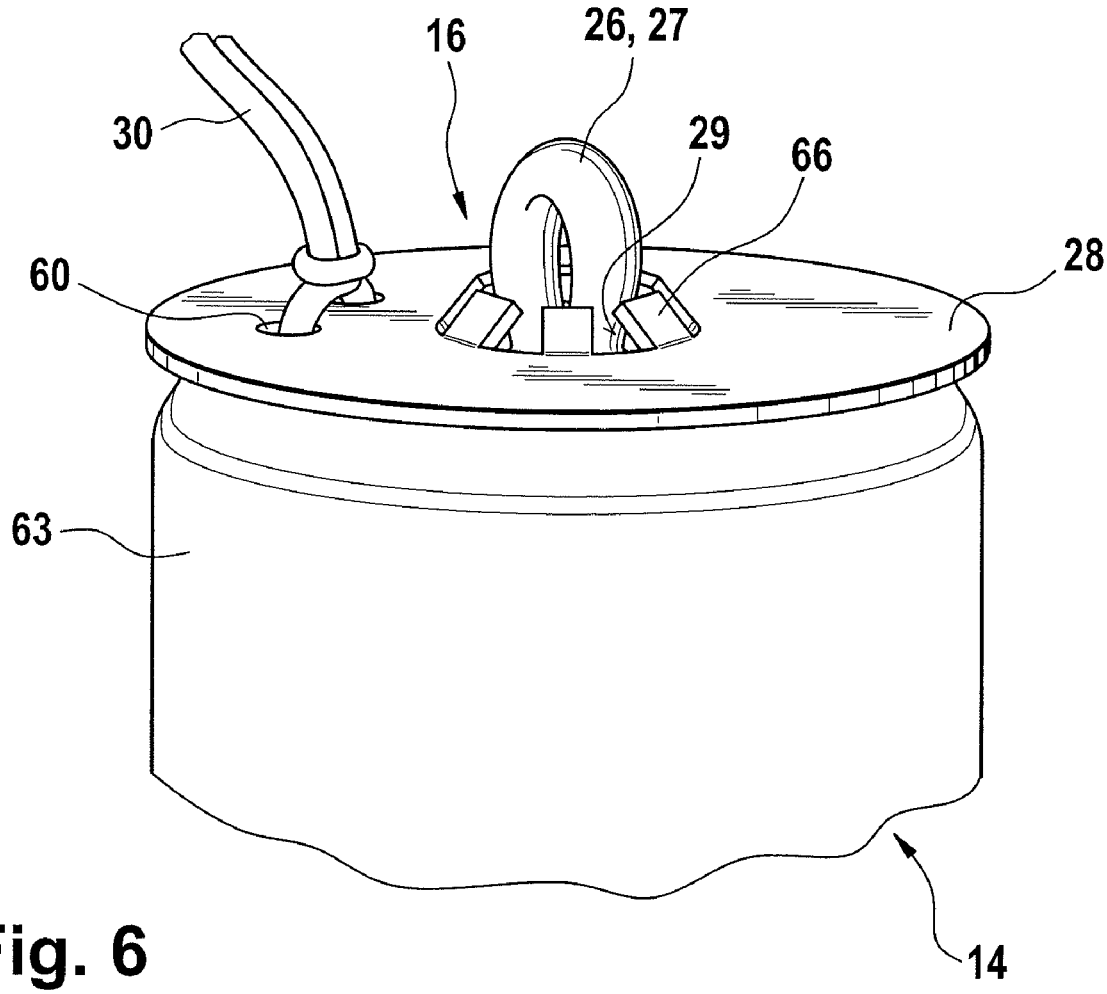
FIG. 6 shows a perspective view of the mated plug connection between the effect charge and that part of the plug connection which is associated with the parachute.

The head 27 of the splint 26 of the effect charge 14 is designed such that it corresponds to the opening 64 with the spring tongues 66 of the disk 28 under the parachute 18. Accordingly, when the head 27 of the splint 26 is pushed through the opening 64 in the disk 28, the spring tongues 66 are deformed elastically by being moved out of the plane of the disk 28 in the direction of the end of the head 27. Once the head 27 of the splint 26 has been passed through the opening 64, the free ends 65 of the spring tongues 66 enter the area of a relatively narrow constriction 29 under the head 27 of the splint 26. The head 27 of the splint 26 is thinner in the area of the constriction 29, so that the spring tongues 66, which have been bent up elastically by the head 27, move back again, entirely or at least partially, in the direction of the plane of the disk 28 (FIG. 6). This results in the disk 28 being held with an interlock in the area of the constriction 29, under the head 27 of the splint 26. The spring tongues 66, which may still be bent up slightly in the direction of the end of the head 27, therefore effectively form barbs, resulting in the disk 28 being hooked or clamped firmly under the head 27 of the splint 26, specifically in the constriction 29. This results in the disk 28 being connected to the splint 26 permanently, by latching means, and with an interlock. The plug connection 16, which is mated in the manner described above, leads to the parachute 18 being connected to the effect charge 14 in a manner which is permanent and virtually impossible to release.

Figure 3:
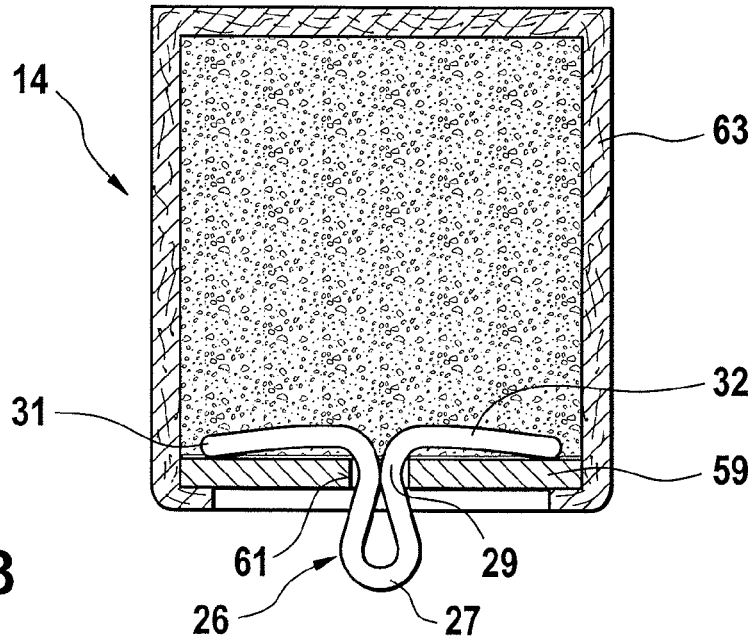
FIG. 3 shows a section through a rotated effect charge of the parachute signaling rocket from FIG. 1, with a part of the plug connection.

The method according to the invention for production of the connection of the parachute 18 and effect charge 14 of the parachute signaling rocket 10 will be described in the following text:

During the production of the effect charge 14, it is provided with the splint 26 which forms the second part of the plug connection 16. Before the casing 63 of the effect charge 14 is closed, the splint 26 is passed through a central hole 61 in its cover 59, and end areas 31 of its limbs 32 are bent out (FIG. 3). During this process, the head 27 of the splint 26, which has not been passed through the hole 61 in the cover 59, remains outside the casing 63 of the effect charge 14, so that the head 27 of the splint 26, and the constriction 29 located underneath it, project upwards out of the effect charge 14, specifically projecting beyond the cover 59.

In FIG. 3, the effect charge 14 with the splint 26 attached to it is shown in reverse, that is to say upside down. In this upside down position, the effect charge 14 is connected to the parachute 18 by mating the plug connection between the effect charge 14 and the parachute 18.

The parachute 18 is connected to the second part of the plug connection 16, that is to say to the disk 28. For this purpose, an end area of the holding line 30 which connects the lines of the parachute 18 is connected to the disk 28, to be precise preferably by knotting, through the attachment openings 60 and 62 in the edge area of the disk 28.

The parachute 18 is therefore arranged in an assembly aid 50, in the same way that it will later be folded up or collapsed in the rocket casing 20, together with the disk 28 connected to the holding line 30. In the illustrated exemplary embodiment, the assembly aid 50 is in the form of an adapter sleeve which is completely open at the upper end face and is at least partially closed at the bottom. The parachute 18 together with the disk 28 attached to it are pushed into the adapter sleeve from above, to be precise such that the disk 28 is freely accessible at the top on the parachute 18 in the adapter sleeve which forms the assembly aid 50 (FIG. 4).

Figure 4:
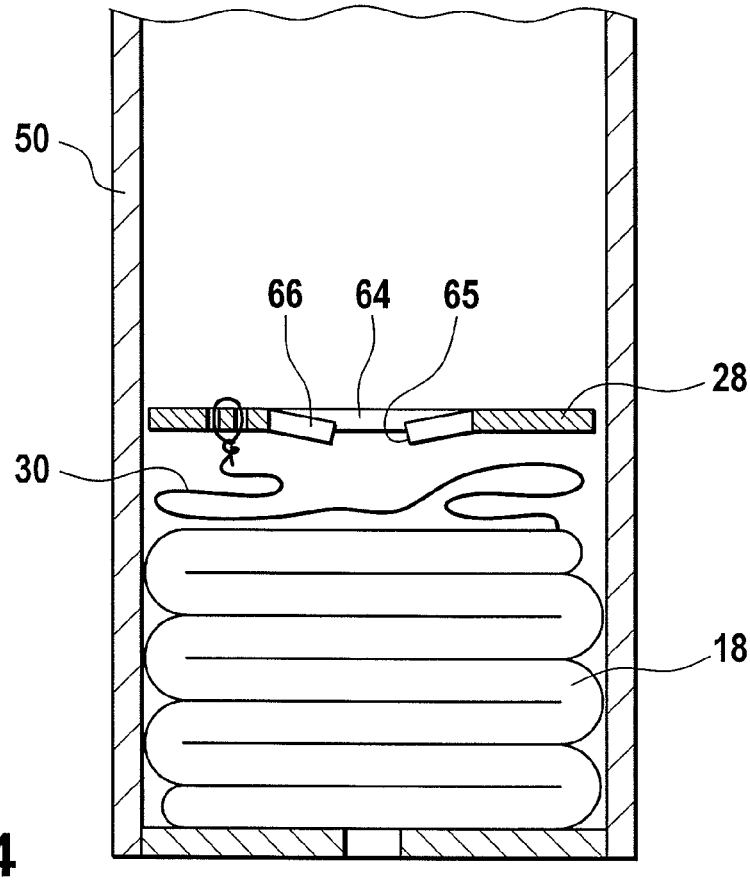
FIG. 4 shows a section through an assembly aid, in which a parachute together with the part of the plug connection attached to it are arranged.
Figure 5:
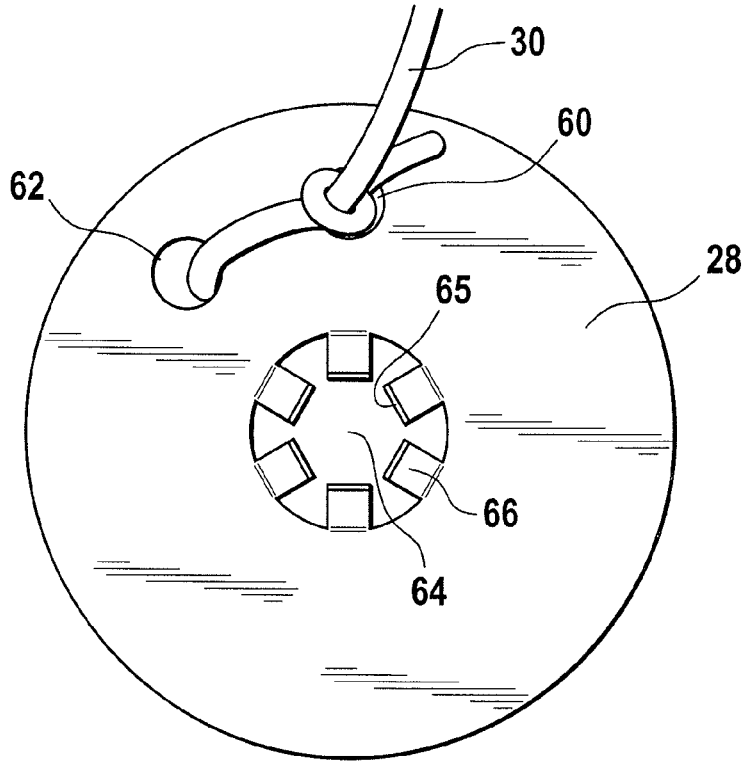
FIG. 5 shows a plan view of a part of the plug connection intended for attachment to the parachute.

The effect charge 14 with the head 27 of the splint 26 protruding downwards is now pushed into the assembly aid 50, in the upside down position shown in FIG. 3, from above, with the assembly aid 50 being in the form of an adapter sleeve which is open at the top, and with the head 27 of the splint 26 automatically being aligned with the center of the disk 28 so that as the effect charge 14 is pushed into the assembly aid 50, the larger head 27 of the splint 26 elastically deforms the spring tongues 66, starting from their free ends 65 which point towards the center of the disk 28, specifically bending them downwards, in comparison to the illustration shown in FIG. 4. This allows the larger head 27 of the splint 26 to pass through the opening 64 in the disk 28 and between the spring tongues 66 which are distributed around the circumference of the opening 64, in order to enter the central opening 64 in the disk 28. Once the head 27 has passed through the opening 64 in the disk 28, the area of the constriction 29, which is narrower than the head 27, reaches the area between the free ends 65 of the spring tongues 66, as a result of which the spring tongues 66 spring back again, to be precise preferably to such an extent that they once again lie virtually, but not entirely, on the plane of the disk 28. In consequence, the spring tongues 66 firmly clamp the splint 26 in the area of the constriction 29 under the head 27, with the spring tongues 66, which are still slightly bent up, acting as barbs making it virtually impossible to detach the plug connection 16, that is to say to separate the parachute 18 from the effect charge 14. This therefore results in the effect charge 14 and the parachute 18 being connected in a manner which is permanent in all circumstances.

Once the plug connection 16 between the effect charge 14 and the parachute 18 has been mated as described above, the two together are pulled out of the adapter sleeve, which is used as the assembly aid 50 and is open at the top, and are plugged as a unit into the rocket casing 20. The other components of the parachute signaling rocket 10 are then installed, with this being done in a manner that is known per se.

A parachute flare rocket or any other rocket or signaling means with a parachute can also be designed and produced in the manner described above in conjunction with the parachute signaling rocket 10.

LIST OF REFERENCES

10 Parachute signaling rocket
12 Propellant charge
13 Firing direction
14 Effect charge
16 Plug connection
18 Parachute
20 Rocket casing
22 Initiator
24 Outer casing
26 Splint
27 Head
28 Disk
29 Constriction
30 Holding line
31 End area
32 Limb
50 Assembly aid
52 Assembly aid opening
59 Cover
60 Attachment opening
61 Hole
62 Attachment opening
63 Casing
64 Opening
65 Free end
66 Spring tongue

What is claimed is:

1. A parachute rocket, having at least one pyrotechnic effect charge (14) and having at least one parachute (18) which is connected to the effect charge (14), comprising:

a) a plug connection (16) for connecting the at least one parachute (18) to the at least one effect charge (14), the plug connection comprising a disk (28) and a splint (26);

b) the disk (28) is connected with at least one connecting line (30) to the at least one parachute (18), the disk (28) comprising an opening (64); and c) the splint (26) is arranged at the at least one effect charge (14), the splint (26) comprising a head (27), wherein the head (27) is plugged into and held in the opening (64) of the disk (28), wherein the opening (64) has at least one associated spring element, wherein the at least one associated spring element is a spring tongue (66), and wherein the spring tongue (66) projects into the opening (64).

2. The parachute rocket as claimed in claim 1, wherein at least one part of the plug connection (16) is arranged on the parachute (18) and at least one part of the plug connection (16) is arranged on the effect charger (14).

3. The parachute rocket as claimed in claim 1, wherein the plug connection (16) comprises parts that are connectable by plugging the parts together.

4. The parachute rocket as claimed in claim 1, wherein the opening (64) has a plurality of the spring tongues (66).

5. The parachute rocket as claimed in claim 4, wherein the plurality of the spring tongues (66) are arranged at the same distance from one another.

6. The parachute rocket as claimed in claim 1, wherein the spring tongue (66) is arranged at an edge of the opening (64).

7. A parachute rocket, having at least one pyrotechnic effect charge (14) and having at least one parachute (18) which is connected to the effect charge (14), comprising:

a) a plug connection (16) for connecting the at least one parachute (18) to the at least one effect charge (14), the plug connection comprising a disk (28) and a splint (26);

b) the disk (28) is connected with at least one connecting line (30) to the at least one parachute (18), the disk (28) comprising an opening (64); and c) the splint (26) is arranged at the at least one effect charge (14), the splint (26) comprising a head (27), wherein the head (27) is plugged into and held in the opening (64) of the disk (28), and wherein the opening (64) is circular, and the spring tongue (66) is arranged at an edge of the opening (64), the spring tongue (66) pointing in the direction of the center of the opening (64).

8. The parachute rocket as claimed in claim 1, wherein the spring tongue (66) is formed integrally with the disk.

9. A parachute rocket, having at least one pyrotechnic effect charge (14) and having at least one parachute (18) which is connected to the effect charge (14), comprising:

a) a plug connection (16) for connecting the at least one parachute (18) to the at least one effect charge (14), the plug connection comprising a disk (28) and a splint (26);

b) the disk (28) is connected with at least one connecting line (30) to the at least one parachute (18), the disk (28) comprising an opening (64); and c) the splint (26) is arranged at the at least one effect charge (14), the splint (26) comprising a head (27), wherein the head (27) is plugged into and held in the opening (64) of the disk (28)

wherein the disk (28) further comprises at least one attachment opening (60, 62), and wherein the connecting lines (30) of the parachute (18) are passed through the at least one attachment opening (60, 62) in the disk (28).

10. The parachute rocket as claimed in claim 1, wherein the connecting lines (30) of the parachute (18) are at least partially composed of heat-resistant material.

11. The parachute rocket as claimed in claim 9, wherein the connecting lines (30) of the parachute (18) are at least partially composed of heat-resistant material.

12. A parachute rocket having at least one pyrotechnic effect charge (14) and having at least one parachute (18) which is connected to the effect charge (14), comprising:

a) a plug connection (16) for connecting the at least one parachute (18) to the at least one effect charge (14), the plug connection comprising a disk (28) and a splint (26);

b) the disk (28) is connected with at least one connecting line (30) to the at least one parachute (18), the disk (28) comprising an opening (64); and c) the splint (26) is arranged at the at least one effect charge (14), the splint (26) comprising a head (27), wherein the head (27) is plugged into and held in the opening (64) of the disk (28), wherein the opening (64) has at least one associated spring element, wherein the at least one associated spring element forms a barb that holds the head (27) on or above the disk (28), and wherein the head (27) comprises a constriction (29), and wherein the at least one associated spring element interlocks with the constriction (29).

13. The parachute rocket as claimed in claim 12, wherein the at least one associated spring element permanently holds the disk (28) under the head (27) by latching means with the interlock.

14. A parachute rocket, having at least one pyrotechnic effect charge (14) and having at least one parachute (18) which is connected to the effect charge (14), comprising:

a) a plug connection (16) for connecting the at least one parachute (18) to the at least one effect charge (14), the plug connection comprising a disk (28) and a splint (26);

b) the disk (28) is connected with at least one connecting line (30) to the at least one parachute (18), the disk (28) comprising an opening (64); and c) the splint (26) is arranged at the at least one effect charge (14), the splint (26) comprising a head (27), wherein the head (27) is plugged into and held in the opening (64) of the disk (28)

wherein the opening (64) has at least one associated spring element, wherein the at least one associated spring element forms a barb that holds the head (27) on or above the disk (28), and wherein the at least one associated spring element is bent up slightly in the direction of the end of the head (27) to form the barb.

15. A parachute rocket, having at least one pyrotechnic effect charge (14) and having at least one parachute (18) which is connected to the effect charge (14), comprising:

a) a plug connection (16) for connecting the at least one parachute (18) to the at least one effect charge (14), the plug connection comprising a disk (28) and a splint (26);

b) the disk (28) is connected with at least one connecting line (30) to the at least one parachute (18), the disk (28) comprising an opening (64); and c) the splint (26) is arranged at the at least one effect charge (14), the splint (26) comprising a head (27), wherein the head (27) is plugged into and held in the opening (64) of the disk (28), and wherein the splint (26) further comprises limbs (32), the splint (26) is held in a cover (59) arranged at the at least one effect charge (14) with the limbs (32) being bent out and arranged on one side of the cover (59) and the head (27) being arranged on another side of the cover (59).

* * * * *